US006615509B1

(12) United States Patent
Vomhoff

(10) Patent No.: US 6,615,509 B1
(45) Date of Patent: Sep. 9, 2003

(54) APPARATUS AND A PROCESS FOR DRYING A PAPER WEB

(75) Inventor: Hannes Vomhoff, Taby (SE)

(73) Assignee: STFI, Stockholm (SE)

( * ) Notice: Subject to any disclaimer, the term of this patent is extended or adjusted under 35 U.S.C. 154(b) by 0 days.

(21) Appl. No.: 09/869,111

(22) PCT Filed: Oct. 8, 1999

(86) PCT No.: PCT/SE99/01806

§ 371 (c)(1),
(2), (4) Date: Aug. 23, 2001

(87) PCT Pub. No.: WO00/39392

PCT Pub. Date: Jul. 6, 2000

(30) Foreign Application Priority Data

Dec. 23, 1998 (SE) ..... 9804569

(51) Int. Cl.[7] ..... F26B 5/14

(52) U.S. Cl. ..... 34/400; 34/454; 34/114; 34/620

(58) Field of Search ..... 34/397–401, 443, 34/444, 452–459, 108–117, 611, 618, 620

(56) References Cited

U.S. PATENT DOCUMENTS 4,586,984 A * 5/1986 Laapotti ..... 162/358.3
4,826,555 A * 5/1989 Long ..... 156/324
4,975,153 A * 12/1990 Nelson et al. ..... 162/358.1
4,976,820 A * 12/1990 Laapotti ..... 162/206
5,071,513 A 12/1991 Bluhm et al.
5,302,252 A * 4/1994 Gotz ..... 162/358.5
5,404,654 A 4/1995 Babinsky et al.
5,620,566 A * 4/1997 Holopainen ..... 162/205
5,683,509 A * 11/1997 Sollinger et al. ..... 118/227
5,709,778 A 1/1998 Kade et al.
6,228,221 B1 * 5/2001 Loser et al. ..... 162/205

* cited by examiner

*Primary Examiner*—Denise L. Esquivel
*Assistant Examiner*—Andrea M. Ragonese
(74) *Attorney, Agent, or Firm*—Dykema Gossett PLLC

(57) ABSTRACT

An apparatus for drying a fibre web of paper or paperboard is provided. The apparatus includes an adjustable heated press nip including at least one pressure device. The pressure device includes a roll, supporting one side of the web and at least two pressure shoes opposite the device and acting on the other side of the web. Each of the pressure shoes include means for providing an individual pressure respectively on the web. At least one intermediate conduit is arranged in-between the pressure shoes. The intermediate conduit includes means forming an additional individual pressure zone on the web.

10 Claims, 1 Drawing Sheet

APPARATUS AND A PROCESS FOR DRYING A PAPER WEB

The present invention relates to an apparatus and a process for drying a fibre web, particularly an apparatus and a process having an adjustable heated press nip containing at least one pressure device, such as a roll, and at least two pressure shoes opposite said device, where each of the pressure shoes contains means for providing an individual pressure respectively on the web.

The process of drying a fibre web during application of pressure with a heated roll or similar pressure device, i.e. so called impulse drying, is a technique that has been under development for the recent twenty years. Bringing a paper web in a press roll nip made the first attempts. Thereafter, a paper web was brought between a felt and a hot metal surface while subjecting a substantial pressure to the felt. By the expression "drying" a fibre web in accordance with the present invention is also meant that the web is subjected to pressing, or dewatered in order to increase its dry substance content.

Later on a slow press roll, which could be heated to temperatures above 300° C., was constructed. A wet paper web and a felt were brought through the nip. However, the apparatus was slow and consequently the press period was long, resulting in a completely dry paper web. Another attempt to find an industrial application for impulse drying was concentrated on substantially increasing the dry content of paper web before introduction in the drying part of the paper machine. In the first experimental plant it was found that delamination of the paper occurred. The explanation to the paper delamination is that when the water content in the paper is heated above 100° C. during a high pressure, whereafter the pressure is decreased to atmospheric pressure after the press nip, a spontaneous evaporation starts. Hence, in order to provide space for the thus formed vapour, the paper may become delaminated.

Numerous proposals how to avoid delamination, have been suggested. For instance, the press roll to be heated has been provided with a porous ceramic coating, for restricting the conduction of heat at a certain temperature and thus the water temperature in the web. This has been combined with several proposals of retaining the pressure a certain period after the nip, to give increasing time for vapour penetration through the web. However, none of the above mentioned solutions presents a satisfactory and useful solution to the problem of delamination.

U.S. Pat. No. 5,404,654 discloses an impulse drying apparatus for the treatment of paper or paperboard web, including a pair of rolls having a nip between them, where at least one of the rolls being heated. A steam chamber is located next to said nip.

U.S. Pat. No. 5,071,513 relates to a method for the mechanical-thermal dewatering of a fibre stock web, where at least two parallel rows of adjustable pressure elements cooperate with a heatable counter roll.

U.S. Pat. No. 5,709,778 discloses a multiple shoe press for a paper making machine. The shoe press has a shoe assembly including a plurality of shoes disposed adjacent each other.

The purpose with the present invention is to minimise the drawbacks of the processes and devices disclosed in the prior art. The object is to eliminate the occurrence of delamination of a fibre web during an impulse drying. A further object is to achieve an apparatus which operates more efficient and can be easily controlled to an increasing extent with respect to what is known in the art.

The present invention provides an apparatus for drying a fibre web, e.g. a web of paper or paperboard, comprising an adjustable heated press nip including at least one pressure device, such as a roll, supporting one side of the web and at least two pressure shoes opposite said device and acting on the other side of the web, each of the pressure shoes including means for providing an individual pressure respectively on the web, where at least one intermediate conduit is arranged in-between said pressure shoes, whereas the intermediate conduit includes means which forms an additional individual pressure zone on the web.

An advantage with the apparatus of the present invention is that the entire pressure profile is better controlled and delamination of a fibre web during a drying treatment can be completely avoided.

A further advantage with the apparatus of the present invention is that if a delamination occurs, the web might be compressed again, totally or to a certain extent, and thus the delaminated area can be at least partly cured and repaired.

In addition, the present invention also relates to a process for drying a fibre web, e.g. a web of paper or paperboard, where the web is subjected to a drying treatment in an apparatus having an adjustable heated press nip formed by arranging at least one pressure device, such as a roll, supporting one side of the web and arranging at least two pressure shoes opposite said device and acting on the other side of the web, each of the pressure shoes including means for providing an individual pressure respectively on the web during the drying treatment, and arranging at least one intermediate conduit in-between said pressure shoes, and providing the intermediate conduit with means serving as an additional individual pressure zone towards the web, and subjecting the web with an additional pressure during the drying treatment.

The press nip according to the present invention involves means for providing heat to the fibre web. The pressure device, roll or counter roll is heatable. Said pressure device has means for providing a temperature exceeding 100° C. in the heated press nip. When the fibre web is subjected to a temperature reaching the evaporating point at the pressure used (i.e. at least exceeding 100° C.), the water in the fibre web will vaporise and the steam produced must necessarily be provided space due to its expansion from water to steam. This may occur inside the web and the web might as a consequence become delaminated. One reason why the operation of compression and curing of a web can be carried out, in accordance with the present invention, is due to the fact that the original structure of the paper is not completely damaged when delaminated into two layers of a web. A suitable upper limit for the temperature applied in the drying treatment can be about 500° C.

The application of a compressive pressure in the press nip may suitably exceed about 0.5 MPa. The outermost upper limit for application of the pressure depends on several conditions, but may be about 10 MPa. The maximum practical pressure applied by the pressure shoes, can be about 6–7 MPa and the pressure can be gradually decreased to atmospheric pressure. The corresponding longitudinal pressure of a roll, or a pressing device, in the press nip in accordance with the present invention, is at least from about 100 kN/m while not exceeding about 1500 kN/m.

It is also within the scope of the invention to arrange a conveying belt, e.g. a steel belt, in between a roll and an opposite pressure device. The conveying belt can serve as support for the web and the belt can serve as the heating zone used for providing the desired temperature in the heated press nip.

The press nip according to the present invention comprises of at least one pressure device, such as a roll, supporting one side of the web. According to the present invention, said device can be an ordinary axial arranged substantially solid roll, preferably made of steel. By the expression "roll" is also meant a hollow cylinder where only the surface represents the shape of a roll. Inside the hollow cylinder body one or more pressure element/elements can be arranged so as to act as pressure elements against the inner walls of the hollow cylinder and consequently performing the desired pressure against the web, placed on the opposite side of the cylinder wall.

On the other side of the web in relation to at least one pressure device, or the preferred roll, the web is in corporation with at least two pressure shoes opposite said pressure device and acting on the other side of the web. The number of pressure shoes used can be up to five, or even more. The number of pressure shoes applied is only limited by practical reasons and depends on the length of the desired total press zone of the nip and the size of each shoe. Each of the pressure shoes has preferably an extension in the transverse direction substantially equal to the width of the transported paper, i.e. along the width of the paper web. Each of the pressure shoes may include means for providing an individual pressure on the web respectively. The means can be mechanical means with a fluid acting as a pressure medium, for example oil or a similar fluid. Preferably, oil is used as medium for said means. The pressure shoes are acting either according to the hydrodynamic or the hydrostatic principle. Hence, in accordance with the hydrodynamic principle, a continuous fluid flow is provided to the pressure shoes. If acting with the hydrostatic principle, each pressure shoe is provided with a fluid from separate chambers. The upper surface of the pressing shoes, in the area facing the web, may be inclined towards the web. Hence, each pressure shoe acting against the web may form a converging press nip.

For the purposes of maintaining a minimum load level in the space between the pressure shoes and thereby avoid a risk for delamination, a pressure level is applied even between the pressure shoes. Hence, according to the apparatus and the process of the present invention, an intermediate conduit is arranged, or formed, in-between at least two adjacent pressure shoes. Preferably, each intermediate conduit has an extension in the transverse direction, i.e. along the width of the paper web, substantially equal to the width of the pressure shoes. The walls and/or surrounding surfaces of the intermediate conduit, which also can be called channel, spacing or the like, may constitute of a specific constructional shaping of its own or formed just by the surrounding surfaces of the pressure shoes. The intermediate conduit includes means, which forms an additional individual pressure zone on the web. Said additional individual pressure zone includes means for providing an individual pressure respectively on the web. Said means can be mechanical means with a fluid acting as a pressure medium, for example oil or a similar medium. Preferably, oil is used as medium for said means. Like the aforementioned pressure shoes, said additional pressure zone is acting either according to the hydrodynamic or the hydrostatic principle. With this new design, the entire delamination can be controlled to a higher degree. It is possible, for instance, to apply a reversed wedge pressure profile, in order to relieve the applied load slowly. Thus, even a slight delamination may occur in said conduits, in the intermediate space between the pressure shoes. The pressure in the intermediate space between each pressure shoe can be relieved significantly, by using a low main or average pressure level, $P_m$. Generation of flashed steam due to overheated water would occur in every pressure shoe, but to a smaller extent, since the residence time in each pressure shoe is shorter. The amount of flashed steam per nip is smaller and this can possibly flow out of the sheet into the felt without delaminating the web. It may still be possible if delamination occurs, to partly or even completely, compress and repair the web again, in accordance with the apparatus and the process of the present invention.

Each intermediate conduit is suitably connected to a common fluid chamber. The intermediate conduit and the fluid chamber form together a closed compartment, serving as an additional pressure element. Intermediate conduits can be arranged between only one pair of pressure shoes or between every adjacent pair of pressure shoes. Intermediate conduits may also be arranged on the outside of the respectively outmost placed pressure shoe.

The pressure shoes, as well as the additional pressure element, can be made of steel or similar material.

With respect to the pressing time for the web in the press nips respectively, said tine may vary from parts of a second up to several seconds, within the used temperature and pressure ranges as mentioned herein.

The fibre web subjected to a drying treatment according to the present invention is preferably a paper web with substantial content of lignocellulose-containing fibres.

With reference to the accompanying drawings, embodiments of the present invention are described, without restricting the scope of the present invention thereto.

Figure 1:
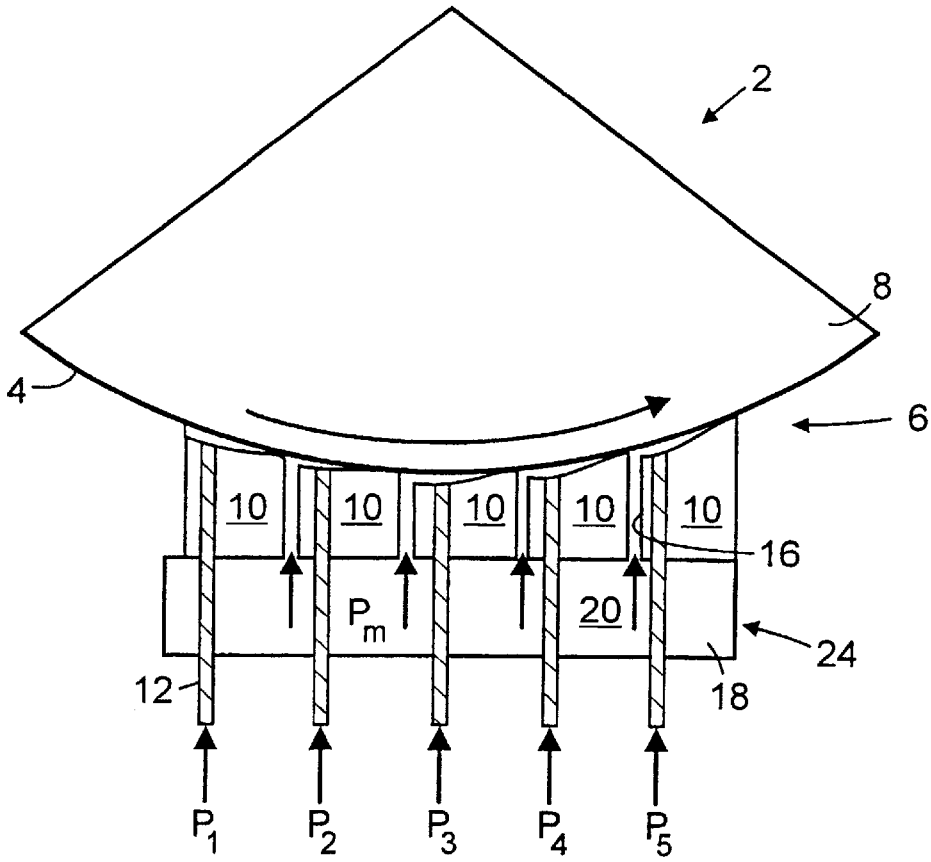
FIG. 1 shows a side view of a principle illustration of an apparatus for drying a fibre web in accordance with the present invention.
Figure 2:
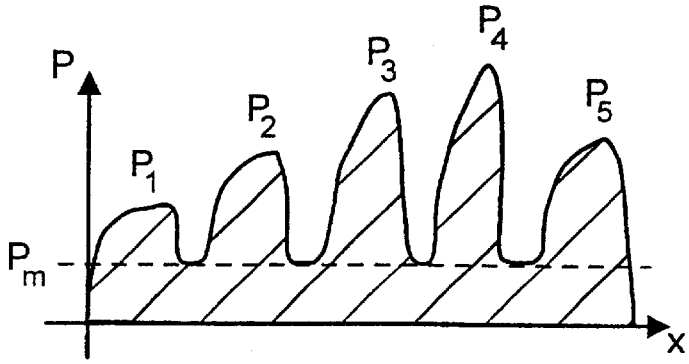
FIG. 2 illustrates in a diagram a possible pressure profile of the apparatus in FIG. 1 during a drying operation.

In FIG. 1, a principle illustration of an apparatus 2 for drying a fibre web 4 is shown. An adjustable heated press nip 6 is formed in a space between a heated roll 8 and pressure shoes 10, opposite the roll 8. Said roll 8 is supported and arranged towards one side of the web 4, and press shoes 10 are acting with varying pressure towards the other side of the web 4. The fibre web 4 is arranged for a continuous travelling over the roll 8, also called backing roll or counter roll. As evident from FIG. 1, five press shoes 10 are arranged against the web 4. Each of the press shoes 10 includes means for providing an individual pressure $P_1$, $P_2$, $P_3$, $P_4$ and $P_5$, respectively, on the web 4. A flow of oil is generally indicated at 12. At least one intermediate conduit 16 is arranged in-between two of said pressure shoes 10, whereas the intermediate conduit 16 includes means 18, 20 which forms an additional individual pressure zone 24 on the web 4. As evident from the diagram in FIG. 2, a possible pressure profile of the apparatus in FIG. 1 during a drying operation is shown. The vertical axis in the diagram represents the added pressure, P. The horizontal axis represents the position, X, in the press zone. In the diagram, five peak pressures ($P_1$, $P_2$, $P_3$, $P_4$ and $P_5$) are shown, which corresponds to the respective pressure zone of each pressure shoe in FIG. 1 with the pressures $P_1$, $P_2$, $P_3$, $P_4$ and $P_5$. Furthermore, as evident from the diagram, a main pressure level, $P_m$, is provided between each of the peak pressures ($P_1$, $P_2$, $P_3$, $P_4$ and $P_5$). The $P_m$ is provided by the additional pressure zone 24 through intermediate conduits in between each pressure shoe.

What is claimed is:

1. An apparatus for drying a fibre web of paper or paperboard, comprising an adjustable heated press nip including at least one pressure device, comprising a roll, supporting one side of the web and at least two pressure shoes opposite said device and acting on the other side of the web, each of the pressure shoes including means for providing an individual pressure respectively on the web, wherein at least one intermediate conduit is arranged in-between said pressure shoes, and wherein the intermediate conduit includes means forming an additional individual pressure zone on the web.

2. An apparatus for drying a fibre web according to claim 1, wherein said means forming an additional individual pressure zone includes a fluid acting as a pressure medium.

3. An apparatus for drying a fibre web according to claim 1, wherein each said intermediate conduit is connected to a common fluid chamber, the intermediate conduit and the fluid chamber together forming a closed compartment, serving as the additional pressure zone.

4. An apparatus for drying a fibre web according to claim 1, wherein the total pressure acting on the web is arranged to provide a pressure in a range from about 0.5 MPa up to about 10 MPa.

5. An apparatus for drying a fibre web according to claim 1, wherein heated press nip has means for providing a temperature exceeding 100° C. in the heated press nip.

6. An apparatus for drying a fibre web according to claim 1, wherein a plurality of intermediate conduits are respectively arranged between every adjacent pairs of a plurality of pressure shoes.

7. A process for drying a fibre web of paper or paperboard, wherein the web is subjected to a drying treatment in an apparatus having an adjustable heated press nip formed by arranging at least one pressure device, comprising a roll, supporting one side of the web and arranging at least two pressure shoes opposite said device and acting on the other side of the web, each of the pressure shoes including means for providing an individual pressure respectively on the web during the drying treatment, comprising the steps of arranging at least one intermediate conduit in-between said pressure shoes, providing the intermediate conduit with means serving as an additional individual pressure zone acting towards the web, and subjecting the web to an additional pressure during the drying treatment.

8. A process for drying a fibre web according to claim 7, wherein pressure is suitably in a range of from about 1 MPa to about 10 MPa.

9. A process for drying a fibre web according to claim 7, further comprising the step of providing means in the heated press nip to affect a temperature exceeding 100° C.

10. A process for drying a fibre web according to claim 7, wherein the additional pressure is provided by the additional pressure zone through intermediate conduits in between each pressure shoe.

* * * * *